US005348304A

United States Patent [19]

Meade

[11] Patent Number: 5,348,304

[45] Date of Patent: Sep. 20, 1994

[54] GOLF CLUB SWING TRAINING METHOD

[76] Inventor: John C. Meade, 620 S. Saxon Blvd., Deltona, Fla. 32725

[21] Appl. No.: 89,478

[22] Filed: Jul. 12, 1993

[51] Int. Cl.[5] ..... A63B 69/36

[52] U.S. Cl. ..... 273/187.6; 359/871; 273/35 A; 273/187 A

[58] Field of Search ..... 359/838, 870, 871, 872; 273/187.6, 187 R, 187 A, 35 A

[56] References Cited

U.S. PATENT DOCUMENTS

| | | | |
|---|---|---|---|
| 4,181,307 | 1/1980 | Krene et al. | 273/35 A X |
| 5,015,084 | 5/1991 | Kryder | 359/838 X |
| 5,035,433 | 7/1991 | Durso | 273/187 A |

FOREIGN PATENT DOCUMENTS

| | | | |
|---|---|---|---|
| 2130103 | 5/1984 | United Kingdom | 273/35 A |

*Primary Examiner*—George J. Marlo

*Attorney, Agent, or Firm*—Allen, Dyer, Doppelt, Franjola & Milbrath

[57] ABSTRACT

A method of improving a golf club swing by providing a planar reflecting surface having a proximal edge, a forward and back side edge, a distal edge that describes a convex arc, the perpendicular distance to which from the center of the proximal edge is dimensioned to fit between the feet of the golfer and the head of the golf club, the golfer in position to take a swing, the reflecting surface dimensioned to provide a view of the golfer from the head to the knees; and support means disposed beneath the distal edge of the reflecting surface of a height sufficient to tilt the reflecting surface toward the golfer to provide a view of the golfer from the head to the knees;

positioning the device so that the support means and proximal edge of the reflecting surface rest on the ground;

positioning the feet of the golfer on the ground adjacent the proximal edge of the reflecting surface;

positioning the head of the golf club on the around adjacent the forward end of the top edge;

viewing the golfer's image in the reflecting surface;

determining a correct alignment of the knees, hips, and shoulders of the golfer;

assuming the correct alignment of the knees, hips, and shoulders;

swinging the golf club backward along the top edge of the reflecting surface, using the hands and wrists;

continuing to view the golfer's image in the reflecting surface;

rotating the hips and shoulders to take the golf club back so that no portion of the reflecting surface is contacted by the golf club;

continuing to view the golfer's image in the reflecting surface; and completing the golf swing.

9 Claims, 2 Drawing Sheets

GOLF CLUB SWING TRAINING METHOD

FIELD OF THE INVENTION

The present invention relates generally to the sport of golf and more particularly to teaching aids and methods, focusing specifically on learning correct alignment and position before and during the swing.

DESCRIPTION OF THE PRIOR ART

It has long been appreciated that the learning of sports can be facilitated by being able to see one's reflection in the process of performing a movement. Theoretically, if one can practice a movement in front of a mirror until it becomes "second nature," that movement will become programmed into the "muscle memory" and will recur seemingly without thought under actual conditions of performance.

Several U.S. patents have issued directed to reflecting devices for use in the teaching of golf, and their devices will be discussed in the following.

Lewis (U.S. Pat. No. 1,410,811) teaches the use of a mirror suspended in front of the golfer showing pictures and diagrams of correct positions.

Richter (U.S. Pat. No. 1,558,762) employs a system of mirrors that reflect the golfer's image juxtaposed with diagrams or pictures to indicate correct postures for a series of movements.

Frenkel (U.S. Pat. No. 3,000,261) teaches an upright casing with an eye for receiving the golfer's image. An optical system of angled mirrors reduces the user's image to ease observation of the entire swing. This portable system provides a full-length, frontal-view reduced image.

Harrison (U.S. Pat. No. 3,097,437) uses a system of three plane mirrors properly oriented to the golfer and a ball to produce and image of the golfer that can be seen while focusing on the ball. The image is full length and frontal view.

Carter (U.S. Pat. No. 3,110,495) employs a system of mirrors adjacent to a golf ball. The system is arranged so that the golfer's entire image is visible, which may be a full-length frontal view reduced in scale by a convex mirror.

Casey (U.S. Pat. No. 3,915,457) teaches a convex mirror and transparent carrier panel with superimposed images for training, both supported by a stand. The golfer is able to view the images and his or her reflection simultaneously, the reflection being reduced-scale full length and frontal view.

Steinman (U.S. Pat. No. 3,917,278) discloses an adjustable convex mirror with horizontal and vertical reference lines to correspond to the golfer's axis of rotation during the swing.

Wolff (U.S. Pat. No. 4,383,687) discloses a carpet on which an adjustable flap pivotally mounts a convex mirror with a variable inclinator. The image, which is visible while the golfer addresses the ball, is a reduced-scale, full-length, frontal view.

McDorman (U.S. Pat. No. 4,563,010) employs sectionalized mirrors, a club facer device, and gradations on a base member to aid the golfer in alignment of feet, shoulders, and club face. In use, the golfer views parts of the alignment before the actual swing is made.

Kelnhofer (U.S. Pat. No. 5,174,566) discloses a diagram of correct movements applied to a mirror as a decal, transparent plastic sheet, or directly via marking means. The image is full length and side view.

Lee (U.S. Pat. No. 5,174,576) discloses a portable thermoplastic mirror in which the golfer may view his or her swing. The mirror is marked with vertical and horizontal lines to indicate proper positioning. The image is full length and frontal view.

Diaz (U.S. Pat. No. 5,190,284) utilizes a base member with a mirror mounted thereon for shoulder alignment. The golfer aligns the feet with the base member and the shoulders by referring to an elongated marking on the mirror. A dowel pin is used to check stance with respect to ball position. The mirror is not used during the striking of the ball.

None of these prior art works discusses or solves the problem of "parallel left" and its elusive nature with respect to the golfer's sight. The problem of safely swinging a golf club and striking a ball in the vicinity of a mirror is also not treated. While proper positioning is emphasized in the previous references, the importance of the golfer's relationship to the target is not adequately addressed.

SUMMARY OF THE INVENTION

The Golf Teaching Aid

The present invention comprises a device for learning and improving one's stance while addressing and striking a golf ball. The system may be utilized with or without a teacher; in the most preferred method of usage, the golfer would employ the device under the tutelage of a professional and then continue practicing what he or she has learned when alone. Since a mirrored surface provides instant visual feedback, attitude and alignment can be seen, rather than just guessed from the outcome of the swing. This device provides information relating the golfer to the target, the ball, and the ground, incorporating the concept of "parallel left," which has not been provided in the prior art. In addition, the teaching aid can be set up easily and is portable, thus being able to be used anywhere, even indoors.

The golf teaching aid to be described herein comprises a planar reflecting surface that rests on the ground with supporting means along the distal edge to tilt the surface in a proximal direction, enabling the golfer to see his/her reflection. The reflecting surface is formed by a translucent sheet positioned atop an opaque sheet. The translucent sheet in the preferred embodiment is made of a 3/16-inch-thick sheet of high-impact, nonglare acrylic thermoplastic material with rigidity sufficient to maintain planarity when the sheet is under zero stress. The opaque sheet in the preferred embodiment is a 3/16-inch-thick sheet of high-impact plastic.

The shape of the device is important for its use, comprising a straight proximal edge, along which the golfer's feet are aligned during use, and forward and back side edges. The side edges terminate at the distal edge, comprising in one embodiment angled edges, which form an angle of approximately 105 degrees with the side edges, and a top edge, parallel to the proximal edge, obviously meets the angled edges at approximately 165 degrees. The geometry of the teaching aid is designed to enable the golfer to take a full and correct swing without the golf club's contacting the device at any point. In use, the swing would proceed along the top edge and, at the point at which the golfer's hips begin to rotate, the club head would swing along the angled edge, avoiding hitting any part of the distal edge.

In another embodiment, the distal edge comprises an arc symmetrical about a line perpendicular to and halfway between the right and left side edges, shaped to permit a full swing without any part of the device being struck by the golf club.

In order to permit full view, support means is provided along the distal edge, the height of which determines the angle the device makes with the ground. In normal use, this angle is approximately 10 degrees, permitting the golfer full view of all areas of the body from the knees to the top of the head, without moving the head away from the correct position with respect to the ball. In one embodiment, these support means comprise four support feet in the form of four spherical members affixed to the device, the spherical feet having a diameter of 1.5 inches. In another embodiment the support means has an adjustable height. In the preferred embodiment the support means comprises a bar affixed near the distal edge of the device.

An additional feature of the teaching aid is provided by marks that may be disposed on any of the four planar surfaces (top and bottom of the translucent and opaque sheets) that can serve as guide lines for alignment. One possible disposition of these lines includes two lines parallel to the proximal edge positioned to assist in knee, hip, and shoulder alignment. An additional two lines, parallel to the side edges, provide ball positioning information.

One method of connecting the two planar surfaces to each other entails utilizing attachment means, for example, screws through the two surfaces that also serve to affix the support means to the device, along only one edge of the device. This method provides the advantage of separability of the two surfaces, enabling the user to customize the apparatus with individualized visualization aids, for instance, by making marks on the top of the opaque surface to assist in positioning parts of the body or golf club during various portions of the swing.

Method of Using the Golf Teaching Aid

The golf teaching aid described above may be used with or without an instructor. When used without an instructor, the golfer utilizes the reflective surface to watch his/her alignment throughout all portions of the swing without having to move the head out of proper golfing position. When used with an instructor, the golfer can utilize the surface to watch his/her alignment as the instructor provides corrections, and either rely on memory to continue using the device when the instructor is not present, or make customized markings to provide reminders.

In either case, the golfer positions the teaching aid between his/her feet and a golf ball, with the toes aligned along the proximal edge of the planar surface. The golf ball should be placed at the forward (relative to the target) end of the top edge of the reflecting surface. The golf club is placed adjacent and behind the ball. The golfer can then check his/her alignment in the reflecting surface, for instance, by aligning the knees and hips with one horizontal rule and the shoulders with another horizontal rule.

When the golfer is satisfied with his/her position in addressing the golf ball, the golf club can be brought backward along the top edge of the reflecting surface. During this portion of the swing, only the hands and wrists should be used; no hip or shoulder rotation should have begun. At the corner formed by the top edge and the back angled edge, the next part of the swing should begin, the golf club head proceeding substantially along, without contacting, the back angled edge of the reflecting surface. During this portion of the swing, the hips and shoulders come into play.

A golfer can also use the teaching aid described without actually striking a ball, that is, by perfecting a practice swing with the use of visual cues provided by the reflecting surface. These cues can also be augmented by additional reminders in the form of instructional material used in conjunction with the reflecting surface, for instance, by placing lines or marks between the transparent and opaque surfaces.

The apparatus can also be used to perfect the forward and backward swings by taking the golf club head along the distal edge of the planar surface, which is dimensioned to serve as a template for a correct swing; that is, the club head is positioned at the forward edge of the top edge, is taken back along the top edge and then along the back angled edge, from where it is lifted behind the shoulders. Then the forward swing is begun, and the golf club head again follows the back angled edge and the top edge, and then follows through along the forward angled edge. For this aspect of the method, the reflecting surface is not necessarily consulted.

DETAILED DESCRIPTION OF THE PREFERRED EMBODIMENT

The Golf Teaching Aid

Figure 1:
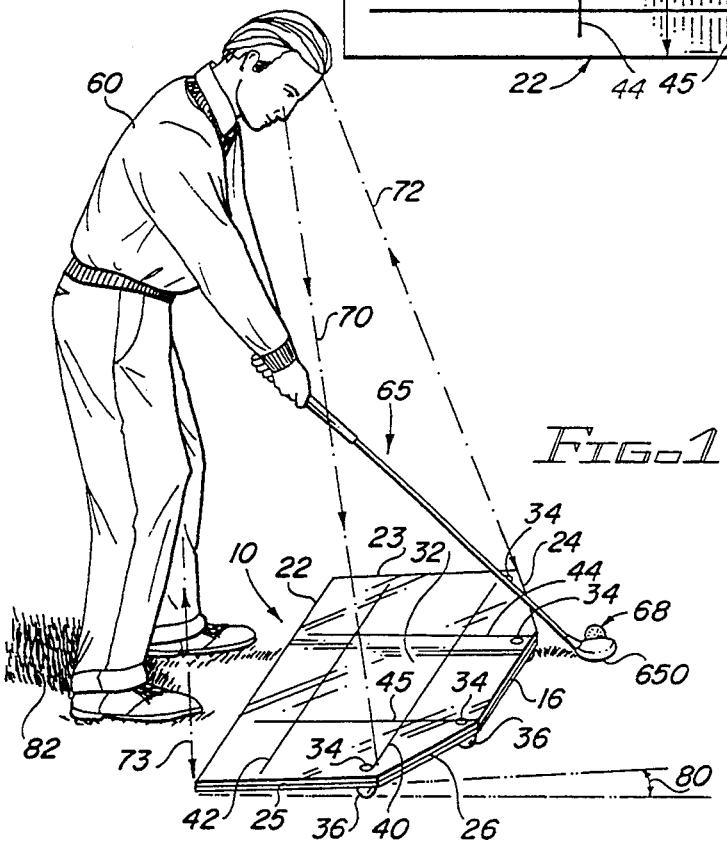
FIG. 1 illustrates a perspective view of the golf teaching aid in use by a golfer holding a golf club and addressing a ball.
Figure 2:
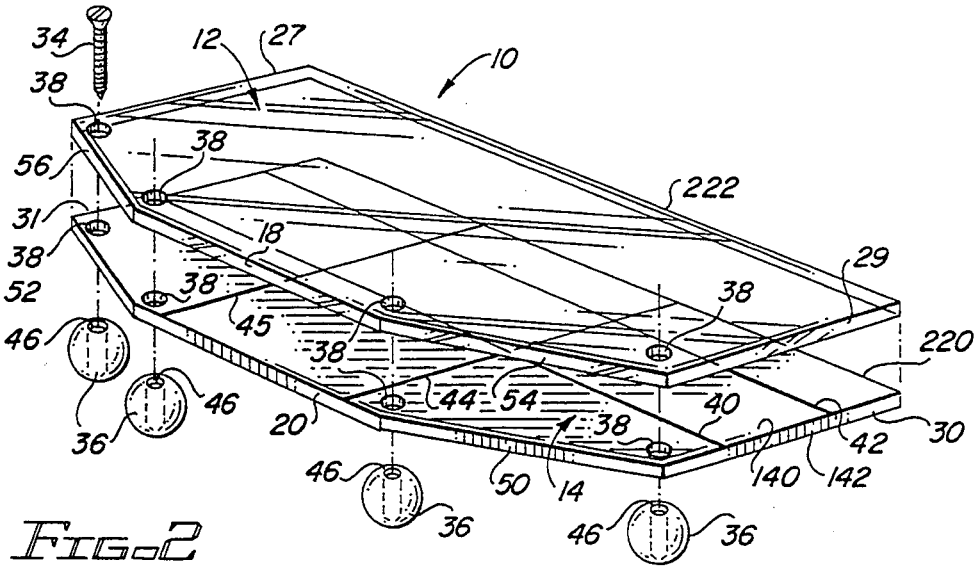
FIG. 2 is a perspective view of the assembly of the golf teaching aid, showing the two coplanar sheets comprising the reflecting surface and the supporting feet.

The golf teaching aid will be described with reference to FIGS. 1–3, wherein the device is referred to generally as 10, the golfer as 60, and the golf club as 65.

The top view of teaching aid 10 has the shape of a rectangle with a trapezoid at its distal edge. Specifically, in the preferred embodiment, proximal edge 22 is 36 inches long. Forward side edge 23 and back side edge 25, at 90 degree angles to proximal edge 22, are each 13 inches long. The distal edge of the device is formed by forward 24 and back 26 angled edges and top edge 16. Forward angled edge 24 and back angled edge 26 are 13.6 inches long and form an angle of 105 degrees with their respective side edges 23 and 25. Top edge 16, parallel to proximal edge 22, is 10 inches long and forms an angle of 165 degrees with each of the angled edges 24 and 26.

As will be seen more clearly in the discussion on the method of using this teaching aid, the dimensions of device 10 may only vary within limits prescribed by normal human height, arm length, and club length. The total width 84 of device 10, from proximal edge 22 to top edge 16, is 15 inches. This width is a parameter that cannot in any embodiment be greater than 20 inches, as golfer 60 must be able to hold a club 65 in proper attitude to ball 68. The cutouts formed by angled edges 24 and 26 permit golfer 60 to take a full swing using club 65 without danger of striking any edge of device 10 along the path of the swing.

In another embodiment, the distal edge may have the shape of an arc designed also to permit the golfer to swing without contacting any edge of the device.

Teaching aid 10 comprises a planar upper translucent sheet 12 affixed in plane-parallel fashion atop planar opaque sheet 14, each having the shape described above, and each having a first and a second surface. The combination of these two sheets 12 and 14 forms a reflecting surface 32.

Translucent sheet 12, a first planar member 3/16 inches thick, has proximal edge 222; forward and back side edges 29 and 27, respectively; forward and back angled edges 54 and 56, respectively; and distal edge 18. In the preferred embodiment, the material is a sheet of high-impact plastic, in the present instance a thermoplastic called LexanR, that will withstand being stepped by a golfer wearing spiked shoes and being struck by a golf ball without cracking or shattering. A further advantage of this material is its antiglare properties, which prevent the user from being temporarily blinded by intense light. The thickness of the sheet is chosen so that its rigidity is sufficient to maintain planarity when under zero stress.

Opaque sheet 14, a second planar member 3/16 inches thick, has proximal edge 220; forward and back side edges 30 and 31, respectively; forward and back angled edges 50 and52, respectively; and distal edge 20. In the preferred embodiment, the material is high-impact plastic, 3/16 inches thick.

In order to permit the golfer to view him/herself, device 10 should be situated at an acute angle 80 to the ground 82, so that device 10 is tilted toward golfer 60. In the preferred embodiment, the support means to effect this tilt comprises four 1.5-inch-diameter spherical feet 36, each having a screw hole 46, affixed via screws 34 passing downward through bore holes 38 in both translucent sheet 12 and opaque sheet 14 and then passing into feet 36. Bore holes 38 occur along the top 16 and angled 24 and 26 edges of device 10: namely, near the points of intersection of forward side edge 23 with forward angled edge 24, of back side edge 25 with back angled edge 26, and of top edge 16 with angled edges 24 and 26.

In another embodiment, the support means may be adjustable, permitting the golfer to adjust the tilt angle commensurate with his/her height.

In yet another embodiment, the support means may comprise a straight bar of width 1.5 inches and length 33 inches affixed near the distal edge of the device.

Figure 3:
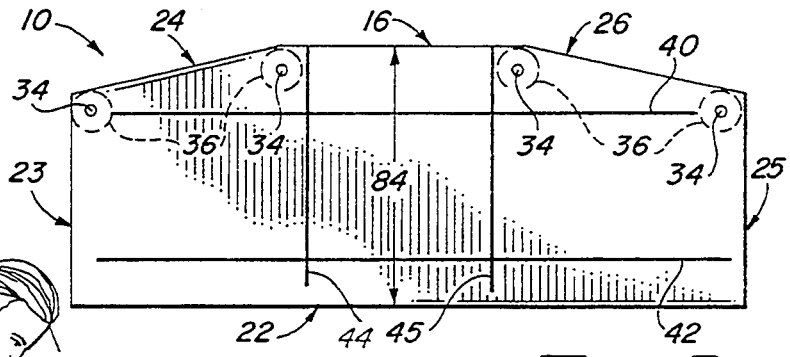
FIG. 3 is a top view of the golf teaching aid, showing the position of horizontal and vertical reference lines and that of the supporting feet.

In one embodiment, reference lines may be affixed to the first surface 140 of opaque sheet 14, as shown in FIG. 3. Forward and back vertical reference lines 44 and 45, parallel to proximal edge 220, serve to orient golf ball position. These extend substantially the full width 84 of opaque sheet 14 and are positioned 15 inches from their respective side edges 29 and 27. Horizontal reference line 40 allows the golfer 60 to orient the shoulders; horizontal reference line 42, the hips and knees. These extend substantially the full length of proximal edge 220 and are positioned 2.5 and 11.5 inches from proximal edge 220, respectively.

Such reference lines and markings may also be affixed to either surface of translucent panel 12.

In addition, since only the distal edges of translucent sheet 12 and opaque sheet 14 are attached, proximal edges 220 and 222 are to a degree separable, and individualized teaching and visualization materials may be inserted between sheets 12 and 14, as will be discussed further in the section on methods. The semiflexible nature of the sheet materials enables this separation, and the noncollinear positioning of attachment points 38 mandates that the lowest-energy configuration consists of the sheets 12 and 14 being parallel and close together; thus sufficiently thin material such as paper inserted between sheets 12 and 14 will be held in place by frictional forces.

Yet another feature is that, since the device has an axis of symmetry along width 84, different reference marks or instructional materials may be affixed to both sides 140 and 142 of opaque sheet 14. The assembly process already described utilizing screws 34 may thus be reversed, withdrawing screws 34 from spherical feet 36 and bore holes 38. Opaque sheet 14 is then flipped over to face surface 142 upward, and assembly is repeated, permitting the user to view the second set of markings through translucent sheet 12.

Method of Using the Golf Teaching Aid

Figure 4:
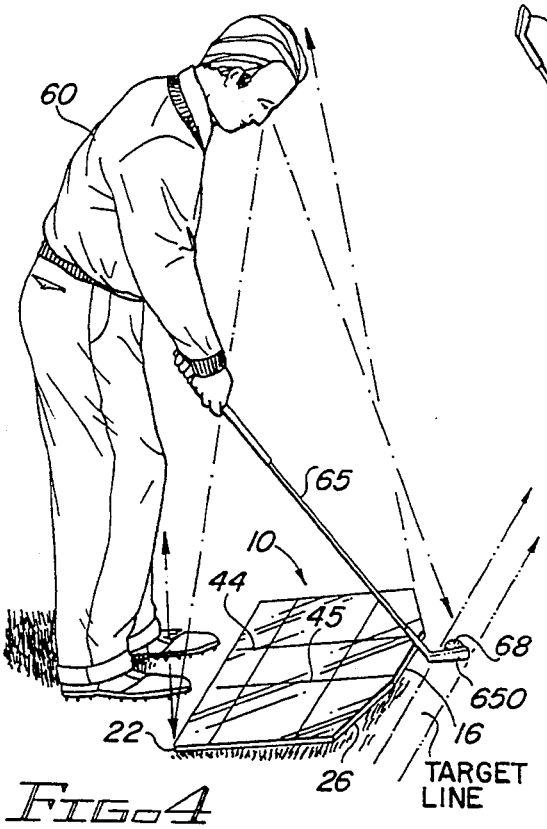
FIG. 4 illustrates the method of a golfer addressing a golf ball using the device of the present invention.

The method of using golf teaching aid 10 will be discussed with reference to FIG. 4, wherein a golfer 60 is shown in the correct attitude holding golf club 65 adjacent golf ball 68.

Figure 5A:
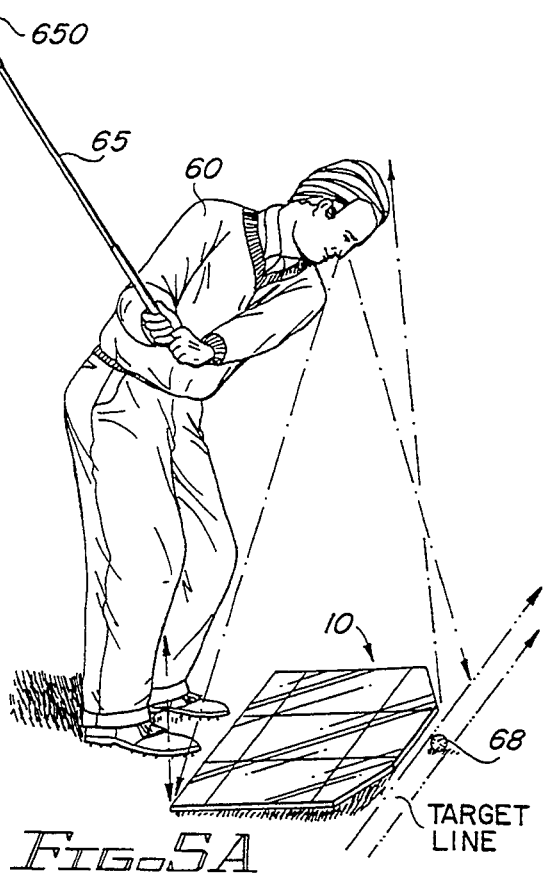
FIG. 5(*a*) illustrates (a) the beginning and (b) the completion of the golfer taking back the golf club while looking at his reflection in the device of the present invention.
Figure 5B:
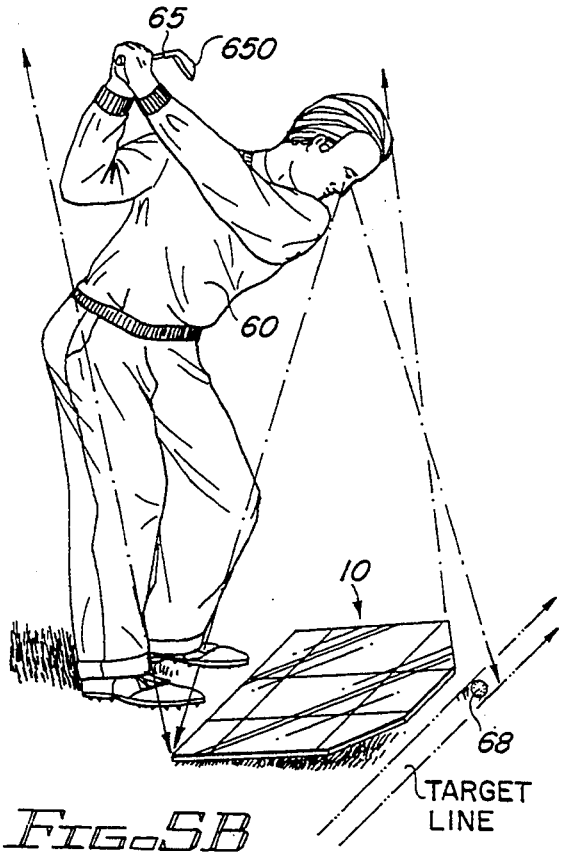
Figure 6:
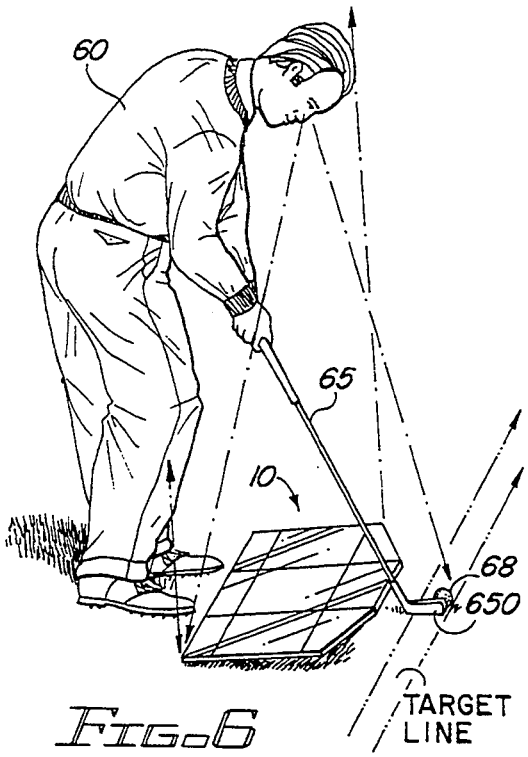
FIG. 6 illustrates the method of the golfer in position to strike the ball while looking at his reflection in the device of the present invention.

The golfer's feet are aligned with the toes defining a parallel line with proximal edge 22 of device 10 and inside vertical lines 45 and 44. Assuming that the golfer wishes to address the ball positioned at the level of the inside of the forward knee, ball 68 is placed at the distal edge of vertical line 44. As the golfer executes his/her swing, the club head 650 follows along top edge 16 by the golfer's moving his hands. When the golf head 650 has reached the junction of top edge 16 and back angled edge 26, the golfer rotates his/her hips, and club head 650 now follows along back angled edge 26 [FIGS. 5(*a*),(*b*)]. The full swing is then completed in the conventional way, rotating the shoulders to take club 65 behind the head (FIG. 6). It can be seen with reference to FIGS. 1 and 4–6 that, throughout this process, golfer 60 has been able to view his/her hip, shoulder, head, and hand alignment in device 10 without adjusting his/her head position. The full sighting of the golfer's body is shown by lines 72 and 73, and the golfer's eye contact with the reflecting surface is shown by line 70.

In the preferred embodiment of the method of using the golf teaching aid 10, the golfer could consult a professional instructor, who would impart the correct position the golfer should assume at each point in the swing. The golfer could then either remember these positions from visual cues noted in the reflecting surface, or could mark points or lines on the device as a reminder when practicing alone. Thus the golfer should always be able to reproduce the swings taught even in the professional's absence, which is often difficult without visual aids.

An additional method of using the golf teaching aid comprises utilizing the distal edge as a template for a correct forward and back swing. Golf club head 650 is positioned at the forward edge of top edge 16. Upon beginning the backward part of the swing, golf club head 650 follows top edge 16 and then back angled edge 26, wherefrom the club head is lifted behind the golfer's head. The forward swing proceeds with club head 650 coming downward and again following back angled edge 26 and then top edge 16, after which the follow-through takes club head 650 along forward angled edge 24. In this aspect the reflecting surface is not required, but it is important that the distal edge of the surface be positioned at a sufficient height from the ground to guide club head 650 along the distal edge of the device; a minimum height of 1 inch is sufficient for this purpose.

It can be appreciated that the present device is dimensioned to aid the golfer with all clubs save the putter, and that a similar device with a smaller width could be envisioned to aid in putting. Alternatively, the present device, being constructed of unbreakable plastic, can be stood upon and the top edge 16 used as a putting or chipping guide.

From the foregoing, it can be seen that a primary object of this invention is to provide a reflection device that can be placed between the golfer and the ball during practice of the golf swing and related positions.

A further object is to enable the golfer to utilize the advantages of a reflective surface safely while swinging a golf club and/or hitting a ball in close proximity to the reflecting device.

Another object of this invention is to disclose an instructional device and method that provide instantaneous feedback via a reflective surface, allowing the golfer to develop a consistently correct stance and technique.

A related object and advantage of this device is to enable the golfer to view positions, techniques, and pace and tempo of the swing without lifting the head or changing perspective in relation to the intended target.

Yet another object of the invention is to provide indicators and marks on the device to encourage proper alignment of parts of the body during portions of the swing. A related object is the ability to customize the training device by making marks related to the user's specific needs.

A further object of the invention is to provide a life-size image of the user without distortion, the image being in close proximity to and easily visible by the user. It can be appreciated that this image is visible throughout the entire swing and strike of the ball without extraneous head motion.

Another object of this invention is to provide a portable and easily assembled device that can be used indoors or outdoors by men, women, and juniors, at any stage of learning from beginners to professionals, right and left handed. The invention also provides a method of using the device with or without a teaching professional to enable efficient learning, instantaneous feedback, and reproducible and consistent results.

A final object of this invention is to provide a golf teaching aid that is simple in design, inexpensive to manufacture, and easy to use.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiments thereof, and the advantageous new and useful results obtained thereby, the new and useful constructions, and reasonable mechanical equivalents thereof obvious to those skilled in the art, are set forth in the appended claims.

What is claimed is:

1. A method of improving a swing of a golf club having a head and held by a golfer, comprising:

providing a golf training device, comprising:

a planar reflecting surface having a proximal edge, a forward and back side edge, a forward and back angled edge disposed at an angle to the forward and back side edges, respectively, and a top edge, parallel to the proximal edge, the perpendicular distance from the top edge to the proximal edge being dimensioned to fit between the feet of the golfer holding the golf club, the head of the golf club resting on the ground adjacent the top edge, the reflecting surface sufficiently large to provide a view of the golfer from the head to the knees; and support means disposed beneath the distal edge of the reflecting surface to tilt the reflecting surface toward the golfer at an angle, the angle of tilt sufficient to provide a view of the golfer from the head to the knees;

positioning the device so that the support means and proximal edge of the reflecting surface rest on the ground;

positioning the feet of the golfer on the ground adjacent the proximal edge of the reflecting surface;

positioning the head of the golf club on the ground adjacent the forward end of the top edge of the reflecting surface;

viewing the golfer's image in the reflecting surface;

determining a correct alignment of the knees, hips, and shoulders of the golfer;

assuming the correct alignment of the knees, hips, and shoulders of the golfer;

swinging the golf club backward along the top edge of the reflecting surface, using the hands and wrists;

continuing to view the golfer's image in the reflecting surface;

rotating the hips and shoulders to take the golf club along the back angled edge of the reflecting surface;

continuing to view the golfer's image in the reflecting surface; and completing the golf swing.

2. The method of improving the swing of a golf club having a head and held by a golfer recited in claim 1, wherein determining and assuming the correct alignment further comprise:

providing instructional markings on the planar reflecting surface;

comparing the reflection of the golfer with the position of the instructional markings; and repositioning the body to conform to the instructional markings.

3. The method of improving the swing of a golf club having a head and held by a golfer recited in claim 2, wherein the reflecting surface comprises:

a top translucent sheet having a first surface and a second surface; and a bottom opaque sheet having a first surface and a second surface, the opaque sheet affixed to the translucent sheet.

4. The method of improving the swing of a golf club having a head and held by a golfer recited in claim 3, wherein the step of providing instructional markings on the planar reflecting surface comprises providing instructional markings superimposed on at least one of the surfaces of the top translucent sheet and the bottom opaque sheet.

5. The method of improving the swing of a golf club having a head and held by a golfer recited in claim 4, wherein the step of providing instructional markings further comprises providing a plurality of alignment rules disposed parallel and perpendicular to the proximal edge.

6. The method of improving the swing of a golf club having a head and held by a golfer recited in claim 3, wherein the step of providing instructional markings comprises inserting instructional material between the translucent and the opaque sheets.

7. The method of improving the swing of a golf club having a head and held by a golfer recited in claim 3, wherein:

the top reflecting sheet comprises a 3/16-inch-thick sheet of high-impact, nonglare acrylic thermoplastic material with rigidity sufficient to maintain planarity when the sheet is under zero stress; and the bottom opaque sheet comprises a 3/16-inch-thick sheet of opaque high-impact plastic.

8. A method of improving a swing of a golf club having a head and held by a golfer, comprising:

providing a golf training device, comprising:

a planar reflecting surface having a proximal edge, a forward and back side edge, a distal edge that describes a convex arc, the perpendicular distance to which from the center of the proximal edge is dimensioned to fit between the feet of the golfer and the head of the golf club, the golfer in position to take a swing, the reflecting surface dimensioned to provide a view of the golfer from the head to the knees; and support means disposed beneath the distal edge of the reflecting surface of a height sufficient to tilt the reflecting surface toward the golfer to provide a view of the golfer from the head to the knees;

positioning the device so that the support means and proximal edge of the reflecting surface rest on the ground;

positioning the feet of the golfer on the ground adjacent the proximal edge of the reflecting surface;

positioning the head of the golf club on the ground adjacent the forward end of the top edge;

viewing the golfer's image in the reflecting surface;

determining a correct alignment of the knees, hips, and shoulders of the golfer;

assuming the correct alignment of the knees, hips, and shoulders;

swinging the golf club backward along the top edge of the reflecting surface, using the hands and wrists;

continuing to view the golfer's image in the reflecting surface;

rotating the hips and shoulders to take the golf club back so that no portion of the reflecting surface is contacted by the golf club;

continuing to view the golfer's image in the reflecting surface; and completing the golf swing.

9. A method of improving the swing of a golf club having a head and held by a golfer, comprising:

providing a golf training device, comprising:

a planar surface having a proximal edge, a forward and back side edge disposed substantially perpendicular to the proximal edge, a forward and back angled edge disposed at 105 degrees to the forward and back side edges, respectively, and a top edge of a length in the range of 8 to 12 inches, disposed at an interior angle of 165 degrees to the angled edges, the perpendicular distance from the top edge to the proximal edge being dimensioned to fit between the feet of the golfer holding the golf club and the head of the golf club, the head of the golf club resting on the ground adjacent the top edge;

positioning the device on the ground;

supporting the top and angled edges so that they are disposed at least 1 inch from the ground;

positioning the feet of the golfer adjacent the proximal edge of the surface;

positioning the head of the golf club on the ground adjacent the forward end of the top edge;

taking the golf club backward along the top edge of the surface;

continuing to take the golf club backward along the back angled edge of the surface;

completing the back swing;

beginning the forward swing;

swinging the golf club forward along the back angled edge of the surface; and swinging the golf club forward along the top edge of the surface.

* * * * *